United States Patent [19]

Hayes et al.

[11] 4,169,422

[45] Oct. 2, 1979

[54] AUTOMATIC CHAIN-STITCH SEWING MACHINE

[75] Inventors: Robert A. Hayes, Franklin Park; James A. Frendreis, Morton Grove, both of Ill.

[73] Assignee: Union Special Corporation, Chicago, Ill.

[21] Appl. No.: 861,075

[22] Filed: Dec. 15, 1977

Related U.S. Application Data

[63] Continuation of Ser. No. 671,882, Mar. 29, 1976, abandoned.

[51] Int. Cl.[2] ..... D05B 21/00; D05B 57/04

[52] U.S. Cl. ..... 112/121.12; 112/201

[58] Field of Search ..... 112/121.12, 201, 197, 112/199, 200, 300, 297

[56] References Cited

U.S. PATENT DOCUMENTS

| | | | |
|---|---|---|---|
| 3,557,727 | 1/1971 | Heimann | 112/121.12 |
| 3,830,175 | 8/1974 | Levor | 112/121.12 |
| 3,965,830 | 6/1976 | Dorosz | 112/121.11 |
| 3,970,016 | 7/1976 | Yanikoski | 112/121.12 |

FOREIGN PATENT DOCUMENTS

| | | | |
|---|---|---|---|
| 1485404 | 12/1971 | Fed. Rep. of Germany | 112/201 |

*Primary Examiner*—Peter Nerbun

[57] ABSTRACT

An automatic chain-stitch sewing machine comprising, a sewing needle, a work holder for retaining a work piece during sewing, and a rotary hook having a hook point for capturing a needle thread loop and drawing the loop through a previous thread loop. The machine has means for spreading the limbs of the previous thread loop, and memory means having a plurality of instructions containing at least directional information designating the direction of movement of the work holder along separate coordinate directions in a plane relative the needle. The machine has means for reading the instructions and for forming electrical signals representing the instructions. The machine also has driving means responsive to the signals for moving the work holder in said plane relative the needle to form a pattern of chain-stitches in the work piece.

9 Claims, 42 Drawing Figures

FIG. 3
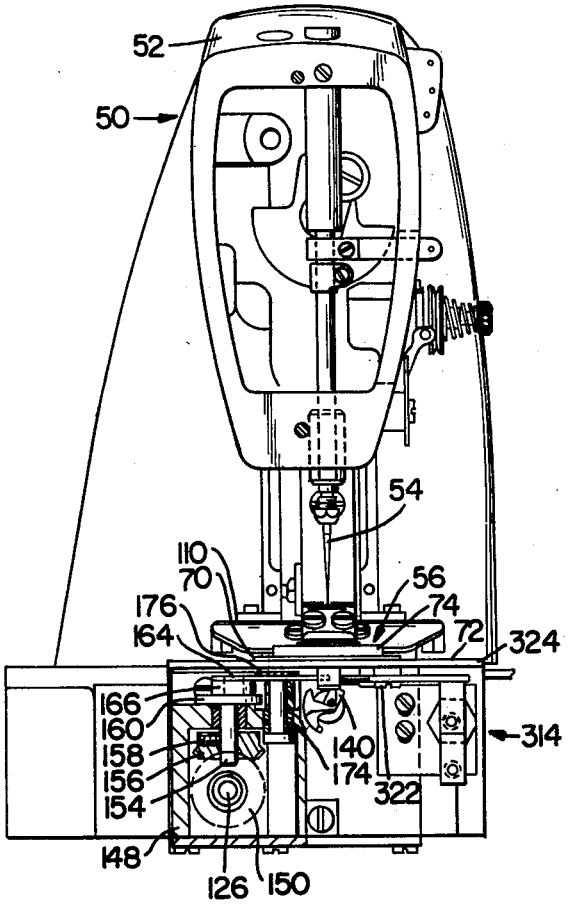
FIG. 7
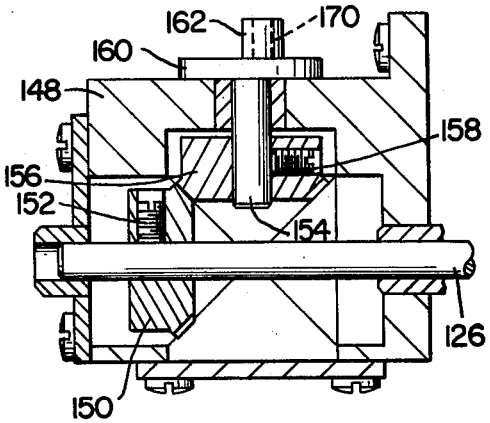
FIG. 8
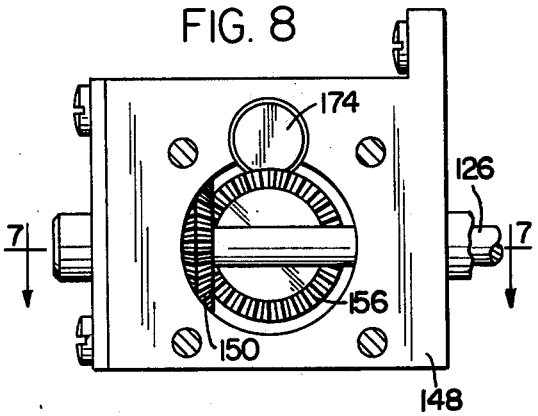
FIG. 14A
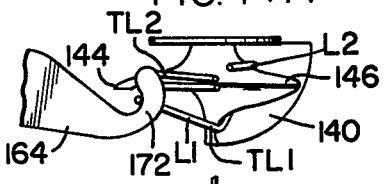
FIG. 15A
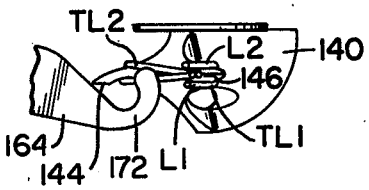
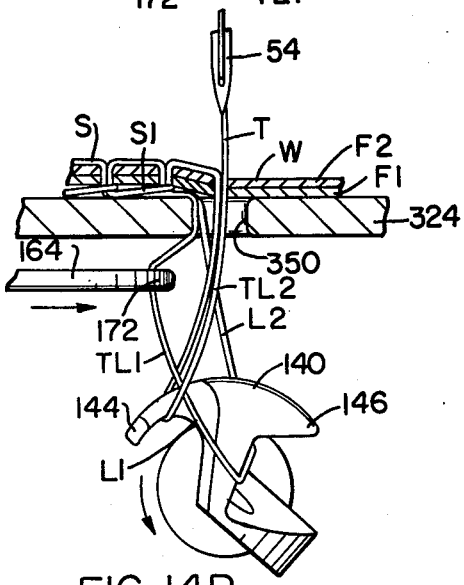
FIG. 14B
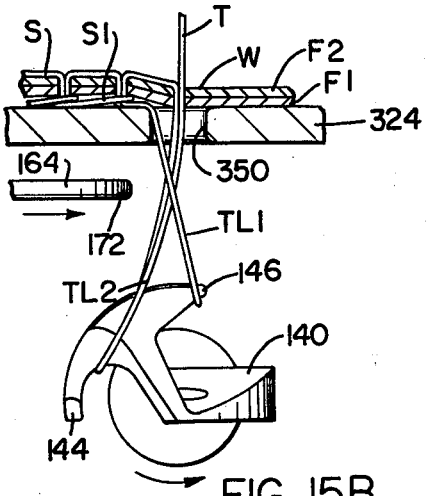
FIG. 15B

AUTOMATIC CHAIN-STITCH SEWING MACHINE

This is a continuation, of application Ser. No. 671,882 filed Mar. 29, 1976 now abandoned.

BACKGROUND OF THE INVENTION

The present invention relates to sewing machines, and more particularly to chain-stitch sewing machines.

Before the present invention, sewing machines of the single chain-stitch type have been proposed for use in forming chain-stitches in a work piece. Such chain-stitch machines have an inherent advantage of operation over machines of the lock-stitch type, since only a single thread is required for sewing and such machines can operate at a greater efficiency.

However, certain problems have been associated with the single chain-stitch machines which have deterred construction of a completely satisfactory machine. Initially, it has been found relatively difficult in such machines to sew the work piece in any given direction in a plane, since in certain directions of work piece movement the descending needle may pass outside the previous thread loop, resulting in a missed or dropped stitch and an interruption of the stitch chain. Additionally, the sewn stitch chain may be readily unravelled from the work piece, and this result has limited the use of such chain-stitch sewing machines. In view of these shortcomings, the single thread chain-stitch machines have not been developed to permit high speed formation of chain-stitch patterns in any direction in the plane under guidance of an electrical control system with an accuracy sufficient to knot the stitch chain and prevent unravelling of the chain.

SUMMARY OF THE INVENTION

A principal feature of the present invention is the provision of a single chain-stitch sewing machine which forms an improved stitch pattern in a work piece.

The sewing machine of the present invention comprises, a sewing needle, a work holder for retaining the work piece during sewing and being movable in a plane relative the needle, a rotary hook having a hook point for capturing a needle thread loop and drawing the loop through a previous thread loop, and means for driving the hook. The machine has means for spreading the limbs of the previous thread loop and retaining them open while the rotary hook passes the captured thread loop through the spread limbs to prevent a missed stitch irrespective of the direction in which the work piece is moved in the plane relative the needle between stitches. The machines has memory means having a plurality of instructions containing directional and positional information designating the direction and magnitude of movement of the work holder along separate coordinate directions in the plane relative the needle. The machine has means for reading the instructions and for forming electrical signals representing the instructions, and driving means responsive to the signals for moving the work holder in the plane relative the needle in the designated directions and magnitudes.

A feature of the invention is that the positional information is potentially variable to designate selected magnitudes of variable distance along both coordinate directions.

Another feature of the invention is that the positional information is capable of designating a fixed position of the work holder relative the needle between successive stitches along both coordinate directions.

Yet another feature of the invention is that the memory means includes a plurality of instructions directing the work holder to form a stitch pattern of chain-stitches in the work piece.

Still another feature of the invention is that the memory means includes a plurality of instructions at the end of the designated pattern directing the work holder to remain at a fixed position along both coordinate directions while reciprocating the needle through the work piece a plurality of times.

Thus, a feature of the present invention is that the sewing machine of the present invention forms a pattern of chain-stitches while directing movement of the work holder along both coordinate directions in the plane relative the needle.

Another feature of the invention is that the sewing machine retains the work holder at a fixed position at the end of the designated pattern in order to form a knotted thread structure below the work piece extending from the pattern.

Yet another feature of the invention is that the knotted thread structure prevents unravelling of the sewn chain-stitch pattern during use of the work piece.

Accordingly, a feature of the invention is that the sewing machine forms a pattern of chain-stitches in the work pieces and accurately positions the work holder to form the knotted thread structure extending from the pattern after the pattern has been sewn.

Still another feature of the invention is that the memory means may include a command to direct a cutting device to sever the thread which extends from the knotted thread structure.

Further features will become more fully apparent in the following description of the embodiments of this invention and from the appended claims.

DESCRIPTION OF THE DRAWINGS

In the drawings:

FIG. 3 is a sectional view taken substantially as indicated along the line 3—3 of FIG. 2;

FIG. 7 is a sectional view taken substantially as indicated along the line 7—7 of FIG. 8;

FIG. 8 is a bottom plan view of a spreader drive mechanism according to the present invention;

FIGS. 10A–15A and 10B–15B are top and end views, respectively, illustrating the operation of a rotary hook and spreader mechanism while forming chain-stitches according to the present invention;

FIGS. 18A–21A and 18B–21B are end and top views, respectively, illustrating use of the sewing machine of FIG. 17 while forming chain-stitches in a work piece;

DESCRIPTION OF THE PREFERRED EMBODIMENTS

Figure 1:
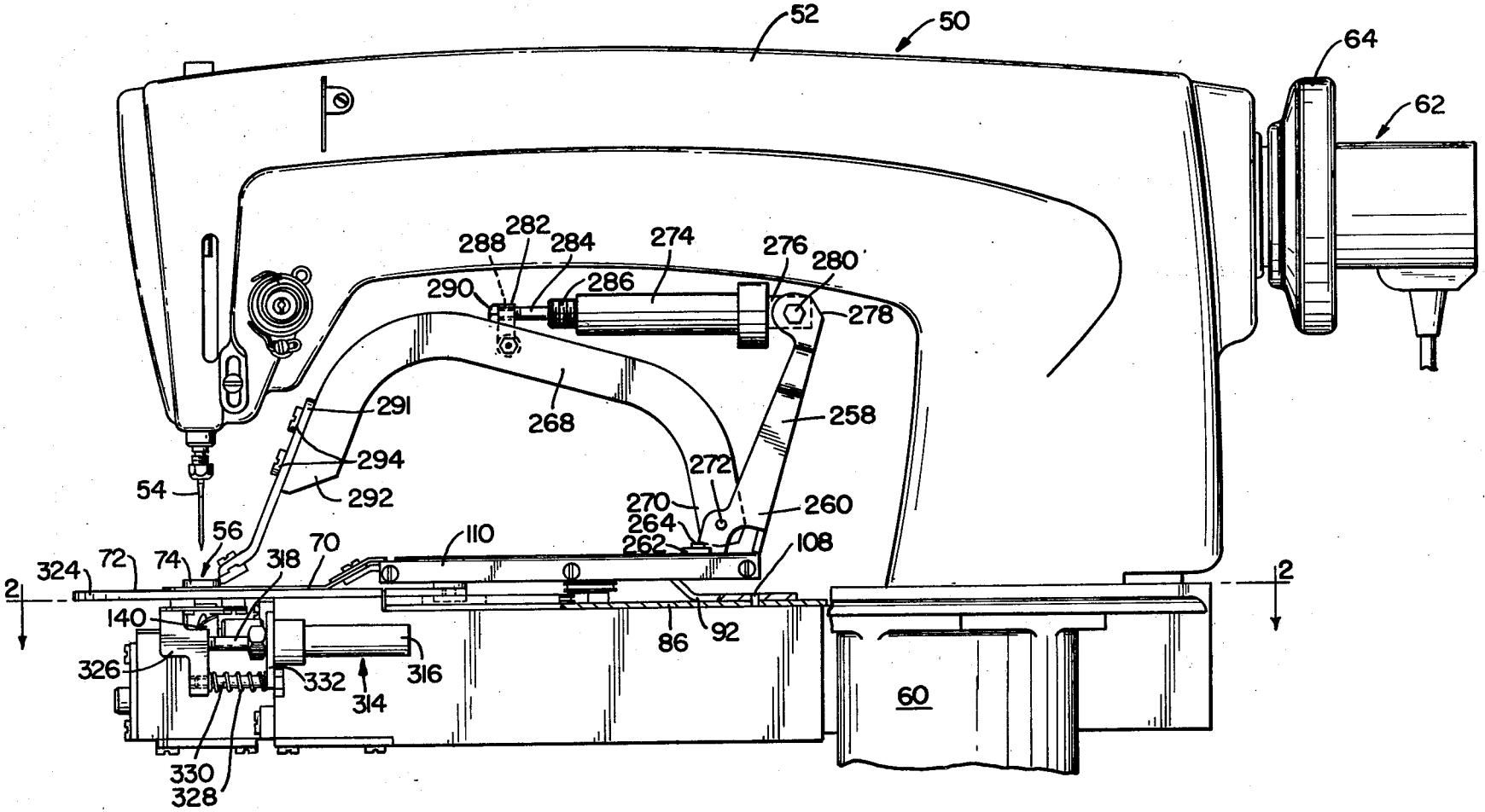
FIG. 1 is a side elevational view of an embodiment of the sewing machine of the present invention.

Referring now to FIGS. 1 and 3, there is shown a single-thread chain-stitch sewing machine 50 which is program controlled and having an overhanging arm 52 which carries mechanical power to a sewing needle 54. The work piece or fabric to be sewn is retained by a work holder generally designated 56 which is moved in a horizontal plane by a power translation system. This system is driven by a pair of stepping motors, including stepping motor 60, positioned on opposite sides of the arm 52 which supply driving power to move the work holder in two coordinate directions, termed the X and Y coordinate or reference directions. The power translation system acts to translate the rotary drive of the stepping motors to movement of the work holder in its two coordinate directions, with the Y coordinate direction being generally aligned with the longitudinal axis of the arm 52, and with the X coordinate direction being transverse to the longitudinal axis of the arm.

The stepping motors are driven by electrical signals from electrical circuitry of a control system, with the signals being synchronized to the movement of the needle 54 into and out of the work piece by an electromechanical synchronization unit 62. The unit 62 is conected to and driven by a hand wheel 64 of the sewing machine, and supplies synchronization signals to the electrical circuitry.

The work holder is moved in a predetermined pattern relative to the movement and position of the sewing machine needle. A sequence of instructions describing the desired pattern of movement and stitching of the work holder 56 is stored in a storage element or memory unit having a plurality of randomly addressable storage locations. The instructions may include information utilized as commands for controlling movement of the work holder and reciprocation of the needle, and positional information for directing movement of the work holder relative the needle in variable distances along the two coordinate directions. Preferably, the storage element is a programmable read only memory, designated a PROM. In such devices the instructions stored in the various storage locations may be changed to describe a desired new pattern of movement. The storage element may also be, for example, a randomly addressable read only memory in which the stored instructions may not be changed to describe a new pattern of movement. Solid state memory elements of both types are available and are preferred. Such elements have a non-destructive readout, eliminating the necessity for rewriting the data into memory after the read operation, and are non-volatile such that data is maintained in memory in spite of power supply disruption.

Electrical control circuitry is provided which reads information from as many of the addressable locations of the storage element as necessary to obtain a complete instruction for each movement of the work holder. It also converts each instruction into a sequence of pulses to be applied to the stepping motors, and thus drives the motors at a time when, as indicated by the synchronizing unit 62, the needle 54 is not engaged in the work piece. In this manner, movement of the work holder is timed not to adversely affect the movement of the sewing needle 54.

As set forth in application Ser. No. 592,951, filed July 3, 1975, and incorporated herein by reference, the power translating system used to transmit power from stepping motors to the work holder 56 comprises two cable systems, or other suitable means, such as gears, with one being provided for each coordinate direction. The cable systems are arranged with separate cables being secured around separate pulleys on the motor shafts, in order to convert rotational movement of the stepping motor shafts into linear movement of the separate cables. A first cable is moved by the motor 60, and is utilized to pivot a pivoting arm 92 about a pivot pin 108 which is attached to a base plate 86 of the sewing machine. The second cable is moved by the other motor, and has opposite ends connected to spaced locations on an extendable arm 110. The work holder 56 is attached to an end of the arm 110, and the arm 110 is carried by the pivoting arm 52, with the extendable arm 110 being radially movable on the arm 52 relative the pivot pin 108, such that movement of the second cable produces radial movement of the arm 110 along the pivoting arm 52. Thus, pivotal movement of the arm 52 results in pivotal movement of the extendable arm 110 and attached work holder 56, while movement of the second cable causes radial movement of the arm 110 and work holder, in order that the stepping motors drive the work holder through the first and second cables along the X and Y coordinate directions relative the needle.

As described in said application Ser. No. 592,951, each of the stepping motors may have an associated homing assembly and limit assembly. The homing assemblies for the stepping motors are utilized to position the work holder during a homing mode at a predetermined home location in the X and Y coordinate directions. The control system automatically enters the homing mode at the beginning and at the end of a sewing operation, the latter comprising a sequence of stitches, during which the work holder is moved to the home position. The home location may be preselected relative the needle by suitable adjustment of the X and Y homing assemblies, and would normally be chosen at a position to permit full range of movement by the work holder in a stitch pattern, as permitted by the limit assemblies. Since the stepping motors are utilized in an open loop condition during a sewing operation, while under program control, the homing assemblies prevent cumulative errors in reference position between consecutive sewing operations by starting each sewing operation at the same home position. Since the work holder and retained work piece are positioned with extreme accuracy at the beginning and end of a sewing operation, auxiliary devices, such as slitting knives, may be utilized in conjunction with the machine even when a high degree of positional accuracy is required.

The limit assemblies are utilized to confine movement of the work holder within a predetermined range of positions, and thus limit movement of the work holder relative the needle in the X and Y coordinate directions.

In this manner, obstruction between a clamp in the work holder and the sewing needle is prevented, which otherwise might result in damage to the machine and possible injury to the machine operation. As will be seen below, the limit assemblies may be adjusted to vary the freedom of movement by the work holder relative the needle.

In a preferred form, each of the homing assemblies has a disc mounted at an adjustable position on a shaft which is driven by the associated stepping motor, and a photosensor is used to locate the edge of a cut-out in the disc. Each of the limit assemblies may have a pair of elongated mechanical stop members mounted at an adjustable position on the shaft, and the stop members strike an abutment rod at preselected rotational positions of the shaft to limit movement of the shaft and the associated motor shaft.

The work holder 56 may comprise any suitable clamp arrangement, or other structure, to retain the fabric while being sewn. As shown in FIGS. 1 and 3, the work holder 56 may include a lower clamp member 70 positioned adjacent a work surface 72 of the sewing machine, and an upper clamp member 74 which is brought into position against the lower clamp member 70 to hold the fabric and which is moved away from the lower clamp member 70 to release the fabric.

As illustrated in FIG. 1, the clamping apparatus includes a forked retaining member 258 having a pair of lower tines 260 and an ear 262 extending from the lower end of each tine 260. The retaining member 258 is secured to the upper surface of the extendable arm 110 by a pair of screws 264 extending through slots in the ears 262, such that adjustment of the retaining member 258 relative the longitudinal direction of the arm 110 can be made through movement of the screws 264 in the slots prior to securement of the retaining member 258.

An arched locking member 268 has its rearward end 270 pivotally mounted between the tines 260 adjacent a lower end of the forked member 258 by suitable means, such as a pin 272 extending through the tines 260 and locking member 268. An air cylinder 274 is also provided for actuating the locking member 268 and clamping device. A rearward end 276 of the cylinder 274 is pivotally mounted between a pair of spaced ears 278 extending from an upper end of the retaining member 258 by suitable means, such as a bolt 280 extending through the ears 278 and the rearward end 276 of the cylinder. The locking member 268 has a bracket 282 extending upwardly from a central portion of the member 268, and the forward threaded end 284 of a plunger 286, which is received in the cylinder 274, extends through an aperture 288 in the bracket 282 where it is secured in place by suitable means, such as a nut 290. As shown, a flange 291 extending from the upper clamp member 74 is secured to a forward end 292 of the locking member 268 by a pair of screws 294.

Prior to a sewing operation, the pressure is reduced in the cylinder 274, and the plunger 286 is thereby retracted into the cylinder. In this configuration, the locking member 268 has been pivoted about the pin 272 to place the member 268 and associated upper clamp member 74 in a raised position, with the upper clamp member 74 being spaced from the lower clamp member 70.

When it is desired to perform a sewing operation, the operator may place the fabric on the lower clamp member 70 with the portion of the fabric to be sewn being positioned in a window of the lower clamp member 70. Next, the operator depresses a foot pedal of known type having a pair of separately actuatable switches. When the pedal is depressed to a first position, a first switch, termed a Pedal Clamp Switch, is actuated, and the control system generates a signal which results in a supply of air pressure from an air source to the air cylinder. In turn, the plunger 286 is driven from the cylinder 274, thus lowering the upper clamp member 74 to a position against the lower clamp member 70, such that the fabric is retained between the clamp members at this time. The operator may then depress the foot pedal to its second position to actuate the second switch, termed a Pedal Go Switch, and initiate a run. Assuming that the clamp is in its proper configuration, as discussed further below, the control system generates a signal responsive to the actuated Pedal Go Switch, and the system automatically enters the homing mode followed by the sewing operation during which the fabric is sewn.

A Clamp Sense Switch may be provided to indicate whether or not the upper clamp member is in its proper configuration for performing a sewing operation. Since it is undesirable to begin the operation while the machine is in a condition with the clamp not fully locked in place, the control system utilizes the signal from the switch to prevent initiation of the sewing operation unless the clamp is in its proper configuration. Due to a time delay associated with placement of the clamp after actuation of the Pedal Clamp Switch, it is possible that the operator may actuate the Pedal Go Switch before the clamp is locked into place. Additionally, the control system prevents initiation of the sewing cycle in the event that the clamp is never properly locked, due to a possible malfunction in the machine.

Figure 4:
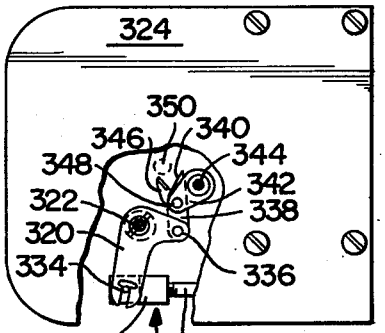
FIG. 4 is a plan view, partly broken away, showing a cutting device according to the present invention.

A thread cutting device generally designated 314 is shown in FIGS. 1–4. The device 314 has an air cylinder 316 which is actuated from a source of air, with the cylinder 316 having a rod 318 which is retracted into the cylinder 316 when actuated. The device 314 has a link arm 320 which is mounted about a screw 322 for pivotal movement on the underside of a throat plate 324. A connecting member 326 is attached to the outer end of the rod 318 and is biased away from the cylinder 316 by a helical spring 328 which extends around a second rod 330 between the connecting member 326 and a plate 332. As best shown in FIG. 4, one end of the link arm 320 is pivotally connected by a pin 334 to the connecting member 326, while the other end of the link arm 320 is pivotally connected by a pin 336 to an end of a first scissors member 338 which has a tapered cutting end 340 remote from the pin 336. The device 314 also has a second scissors member 342 having an end pivotally mounted by a screw 344 beneath the throat plate 324 and having a tapered cutting end 346 extending generally at a right angle from the remainder of the second scissors member 342. As shown, the first and second scissors members 338 and 342 are pivotally connected by a pin 348 intermediate their ends, such that the respective cutting ends 340 and 346 of the scissors members are spaced from each other and are spaced from an opening 350 in the throat plate 324 during the normal configuration of the device.

As will be further discussed below, the control system causes actuation of the cylinder 316 to initiate the cutting sequence at the end of a sewing operation or pattern. In turn, the rod 318 is retracted into the actuated cylinder 316, causing pivotal movement of the link arm 320 in a counterclockwise direction about the screw 322, as viewed in FIG. 4. The pivoting link arm 320 moves the first scissors member 338 about the pins 348 and 336, causing rotation of the second scissors member 342 about the screw 344. As a result, both scissors members 338 and 342 pivot about the pin 348, such that the respective cutting ends 340 and 346 move forwardly toward the opening 350 and close to cut the thread beneath the throat plate. After the cutting procedure has been completed, the rod 318 is withdrawn from the cylinder 316 by the spring 328 acting on the connecting member 326 in order to position the device 314 in its normal configuration, as shown in FIG. 4. The cutting device 314 is actuated by the control system in response to a Move Without Stitch Command in the PROM at the end of a sewing sequence, or in response to an End of Program Command in the PROM at the end of a complete sewing operation, after which the work holder is returned to its home position.

For proper operation of the apparatus, the movement of the work holder should be synchronized to the stitching cycle so that the work holder is moved only when the needle is removed from the work peice. Furthermore, the sewing machine should stop at the end of a sewing cycle with the needle in the up position in order that the work holder may be moved to the home position and the sewn work piece may be removed from the work holder after the clamp is raised. Thread cutting is also done as part of the "needle-up" sequence. These functions are performed by a commercial apparatus 346, Quick, Model No. 800-ST-362, in conjunction with the synchronization unit 62 and the control system. Current from three active slip rings or photosensors of the unit 62 is supplied to the Quick device to synchronize its operation, and separately provide a signal at the needle up position for cutting. The control system and the synchronization unit 62 in conjunction with the Quick device cause the sewing machine (a) to run at fast speed or slow speed; (b) to stop the machine with the needle in its up position; and (c) to actuate the thread cutting device 314. The synchronization unit 62 and sewing machine is driven by the Quick device through an endless belt which passes around pulleys connected to the unit 62 and the Quick device.

The unit 62 may have primary and auxiliary photoreflective transducers mounted on the inner surfaces of plates in a position of alignment with a notch of a rotating ring, with the notch having a non-reflective surface coating within its confines. In operation, light emitted by the transducers strike the surface of the ring and is reflected to an optical sensing portion of the transducers, creating two independent output currents. The output currents of the transducers remain constant except during the time they are aligned with the non-reflective notch of the ring, at which time the amount of reflected light is greatly diminished. Accordingly, the output signals change when the edges of the notch reach alignment with the respective transducer, and the signal change when the notch first reaches alignment with the transducers is utilized by the control system to provide an indication of the needle position. Alternatively, the synchronization unit may have a pair of rotating discs having cut-outs, and a pair of associated photosensors to determine when the cut-outs are aligned with the respective photosensor.

During normal operation of the machine, the signal from the primary transducer is connected to the control system, and this signal termed the Needle Disengage Sensor-P signal, indicates the time at which the needle is about to leave the fabric and when the work holder may be moved without damage to the needle. The position of this transducer may be modified by suitable adjustment of a bracket in the unit 62, in order to signal the precise time desired.

During normal operation, the auxiliary transducer is disconnected from the control system as controlled by a Normal/Service Select Switch. However, when a service mode for the machine is entered through use of the switch, during which time the function of the machine may be checked by a serviceman, the signal from the primary transducer is disconnected from the control system, and the signal from the auxiliary transducer is connected to the control system and used as the signal Needle Disengage Sensor-P. Although under program control, during the service mode the machine operates at a slow speed even if a fast speed command has been received. Accordingly, the machine timing is determined by the transducer during the service mode to assure that movement of the work holder takes place while the needle is disengaged from the work piece.

The Quick device, although commercially designed for actuation by a treadle, is made fully automatic herein. Under program control, the control system normally starts the machine at its fast speed responsive to a sequence of Fast Sew Commands contained in program memory. In this configuration, the control system energizes a main clutch/brake solenoid for operation of the machine at fast speed. Shortly prior to completion of the sewing operation or prior to movement of the work holder without stitching, the control system operates the machine at the slow speed for a short period of time responsive to a few consecutive Slow Sew Commands in memory. The sewing machine uses a signal from the synchronization unit to stop reciprocation of the needle at its up position, and then actuates the thread cutting device.

As noted above, the addressable storage element which is preferred in this embodiment is a programmable read only memory unit or PROM. With the proper equipment, the operator of the automatic sewing machine according to this invention can change or add programs (i.e., instructions or a sequence of instructions) to a PROM. Depending on the information capacity of each storage location and the information content of each instruction, a single instruction may be stored in a single storage location. On the other hand, in the preferred embodiment of the invention, each instruction utilizes more than one storage location. The sequence of instructions stored describes a pattern which the automatic sewing machine work holder will follow. In this particular embodiment, the PROM has a randomly addressable eight binary digit (bit) word in each storage location and a total of 256 such locations.

Each instruction includes a command and work holder positioning data for the X and Y coordinate directions. In the preferred embodiment there are four commands. The first command directs movement of the work holder without stitching (Move Without Switch Command); the second directs movement of the work holder while stitching slowly (Slow Sew Command); the third directs movement of the work holder while stitching at a fast rate (Fast Sew Command); and the fourth indicates the end of the sequence of instructions and directs movement of the work holder to its home position (End of Program Command). Each of the first three commands recited above utilizes two groups of positioning data to form a complete instruction. Each data group includes directional and stepping information necessary for a different one of the two coordinate directions to determine the next position of the work holder. While there are many possible ways of providing this information, it is preferred to construct each data group as a signed number which indicates the number of steps and the direction in which the work holder is to be moved. Thus, this particular embodiment of the invention utilizes an open loop system, that is, the work holder is moved from place to place during a sewing operation without the necessity of any feedback to indicate its present position. The maximum allowable number of steps in each coordinate direction during each sewing cycle may be fifteen per instruction, although the number of steps permitted while operating the machine at its fast speed may be reduced slightly, e.g., twelve, due to possible timing restrictions.

In this embodiment, each instruction, when written in binary utilizes twelve bits. The designation of the command portion of each instruction requires two bits and the work holder positioning data requires five bits for each coordinate direction, one for the direction (positive or negative) and four bits to designate the number of steps, which may be zero steps in one or both coordinate directions, if desired, in which case the work holder does not move in the designated coordinate direction or directions. As further described below, the control system reads three separate four bit words for use as a single twelve bit instruction. Once the PROM has been programmed, that is, once the PROM contains a sequence of instructions in a predetermined order to describe a desired sewing pattern, the sewing machine is ready for operation. A Program Select Switch may be provided to select the mode of operation for program control by setting the switch at one of a plurality of positions. Each PROM may have two banks, termed Banks A and B, containing 256 four bit words. The control system begins reading the four bit words at a low order address in one of the banks, and reads three four bit words from sequential storage locations in the given bank to form the twelve bit instruction during each timing cycle of the sewing machine. In this manner, the control system sequentially reads the data from the bank. If two programs are sufficiently short to be programmed into 256 four bit words, one program may be placed entirely in Bank A, while the other program is located in Bank B. Before starting a sewing operation, the operator may select the desired program by placing the setting for the Program Select Switch at the appropriate position, one position being provided for Bank A, and another for Bank B. In this configuration, when a sewing operation has been completed, the control system will remain selected at the chosen bank until the switch setting has been changed. For example, if Bank B had been selected by the Program Select Switch, each sewing operation will be performed as directed by the program contained in Bank B, so long as the Program Select Switch remains at the Bank B setting.

Alternatively, the operator may place the Program Select Switch at a third position, termed the Remote setting or mode. In this configuration, the operator may change program control between Banks A and B, as desired, by depressing a foot pedal. Assuming that a given sewing operation has been performed as directed by the program contained in Bank A, each subsequent sewing operation will be controlled by the Bank A program until the foot pedal has been depressed, which actuates a Remote Program Select Switch. Accordingly, the next sewing operation will be performed in accordance with the program contained in Bank B. The operator may again select Bank A by depressing the foot pedal, and the banks may be selected to perform sewing operations alternately from the two banks, if desired.

If the program is too long to be retained in a single bank, the first portion of the program is placed in Bank A, while the remainder of the program is located in Bank B. In this case, the operator selects a fourth position by the Program Select Switch, placing the system into an Extended mode. In this configuration, during each sewing operation the control system first reads the portion of the program contained in Bank A. When this part of the program has been completed, the control system automatically begins reading the remainder of the program located in Bank B for completion of the sewing operation. In this manner, a relatively long program may be utilized to perform a lengthy sewing operation without interruption of the sewing sequence. Of course, the PROMS may be changed between sewing operations to connect different programs to the control system. As a precaution, power is removed from the control system while PROMS are being changed.

A plurality of suitable switches may be provided for controlling and monitoring the operation of the control system and sewing machine. Actuation of a momentary Reset Switch initializes the control system for performing a sewing operation, and may be utilized in an emergency situation to terminate a sewing operation prior to its normal completion. Another switch, termed the Clamp Switch, may be utilized to cause mandatory lowering of the clamp, or place it under automatic control of the foot pedal and control system. A third switch, called a Pattern Drive Switch, may be utilized to inhibit operation of the X and Y stepping motors during check-out of the machine. Of course, a switch may be utilized to control power turn on and turn off for selectively supplying power to the control system and machine.

A Normal/Service Select Switch has already been described. When this switch is placed in its Normal setting, the control system operates in its normal condition for performing sewing operations while utilizing the signal from the Primary Needle Disengage Sensor of the unit 62 for synchronizing initiation of work holder movement. The Service setting of the Normal/Service Select Switch is utilized by a serviceman during checkout of the machine. In this configuration, the machine does not operate until a Jog Switch has been reset. As previously discussed, the control system utilizes the Auxiliary Needle Disengage Sensor of the unit 62 to synchronize movement of the work holder during the Service mode.

Figure 31:
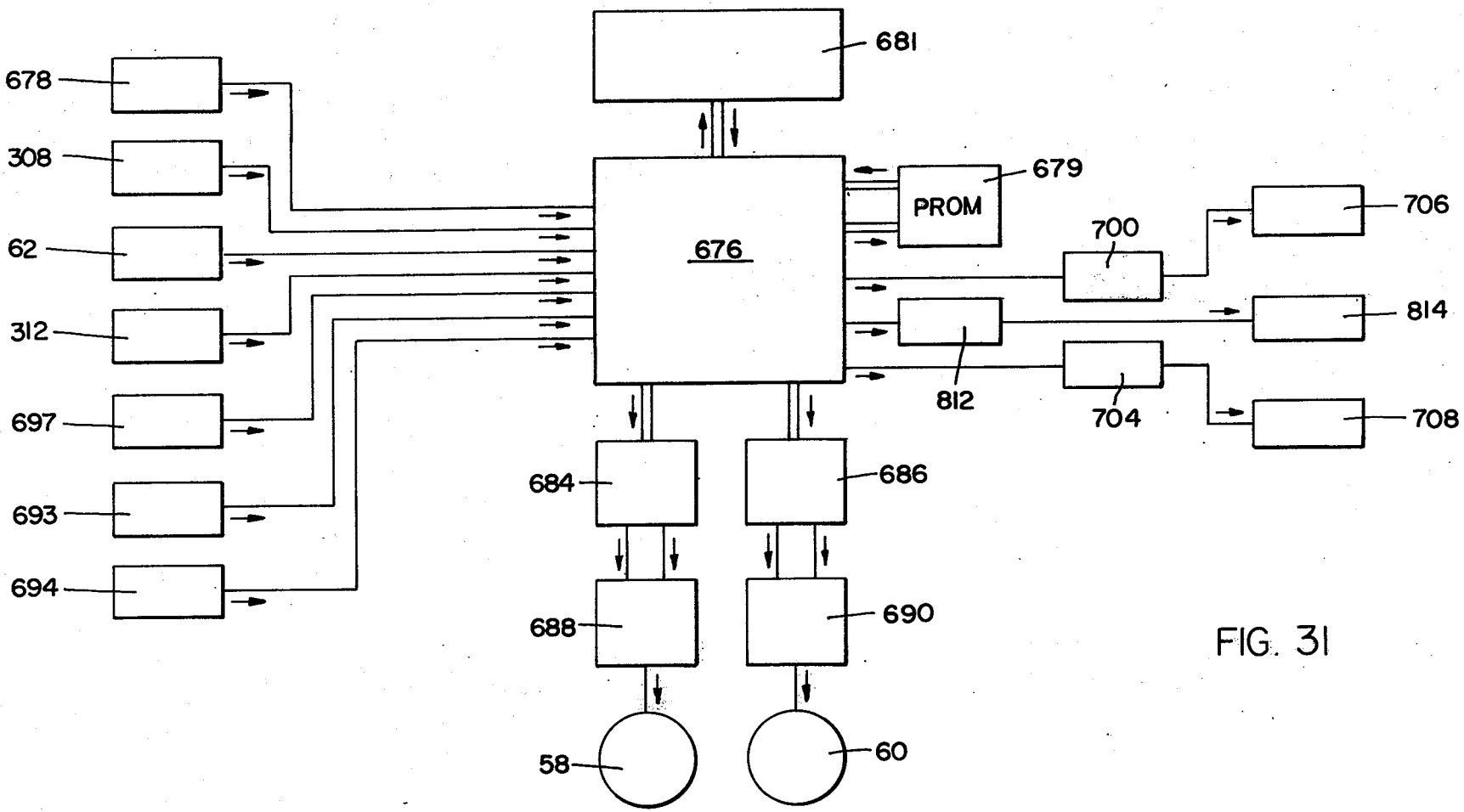
FIG. 31 is a block diagram of the electrical signal flow paths in a control system for the sewing machine of the present invention.

Referring now to FIG. 31, the operation of the sewing machine is controlled by a central control logic 676. First the operator places a work piece in the proper position in the work holder 56. Then, when the foot pedal 678 of the sewing machine is partially depressed by the operator, actuating the Pedal Clamp Switch during placement of the fabric in the work holder, as previously described, the central control logic 676 generates signals to lower the clamp and hold the fabric. After the clamp has been lowered, the foot pedal 678 is fully depressed by the operator to actuate the Pedal Go Switch, and, if the clamp has been fully closed, as indicated by the clamp Sense Switch 308, automatic operation of the machine begins. In normal operation, a "homing" cycle is first initiated. Thereafter, the first instruction is read by the logic 676 from the storage element 679, here shown as a PROM, according to the setting of the Program Select Switch of a front panel 681. This logic responds by providing the correct number of pulses for moving the work holder, and, after a signal from the electromechanical synchronization unit 62, transmits these pulses to motor drive logics 684 and 686. The drive logics 684 and 686 drive respectively power drivers 688 and 690 which in turn drive the two stepping motors 58 and 60 in the desired direction and through the desired rotation.

The pulses to the drive logics 684 and 686 are arranged to be aperiodic to increase the machine cycle rate, and to prevent unwanted oscillations and therefore unwanted feeding of the work piece against the needle. The work piece thus moves in a true intermittent motion, the work piece being stationary when the needle is inserted into it. More particularly, the central control logic 676 includes means for spacing the first three pulses of a series of pulses and the last two pulses of the series further apart than any remaining intermediate pulses. The next instruction is then read and carried out, followed by the one after that, etc., until the last instruction has been implemented. In response to the last instruction which will be an End of Program Command or Stop Command, the central control logic causes the Quick device to halt the sewing machine, causes the thread to be cut, and then initiates a second homing cycle. The homing cycle is controlled by the central control logic, which, in response to the signals from the homing optical sensors 693 and 694 of the homing assemblies, cycles the stepping motors to return the work holder to its radial and pivotal home location.

Other inputs to the central logic are from circuitry 697 which generates the End of Cut Signal after the thread has been cut, and a Thread Break Sensor 312 which signals the control logic 676 of a break in the needle thread. Upon receipt of a break signal from the sensor 312, the control logic 676 causes the Quick device to halt the sewing machine, and inhibits any further movement of the work holder by stopping and incrementation of an address counter 772 (FIG. 32) which sequentially addresses the storage element. Thus, the address in address counter 772 is preserved and the control logic 676 waits for a signal from the front panel before starting up again. Once the thread or needle has been repaired and replaced, the operator may restart the machine at the beginning of the sewing pattern or restart it at the instruction following the instruction at which the break occurred.

Depending upon whether an instruction requires slow or fast stitching, the control logic 676, in response to that instruction, will signal, through a driver 700, a control box 706 of the Quick device to cause the machine to stitch at the required speed. If an End of Program Command is read, the control logic 676 deactivates the main brake/clutch valve solenoid 708, associated with the Quick device, through a driver 704 to initiate the stopping sequence of the sewing machine.

Figure 32:
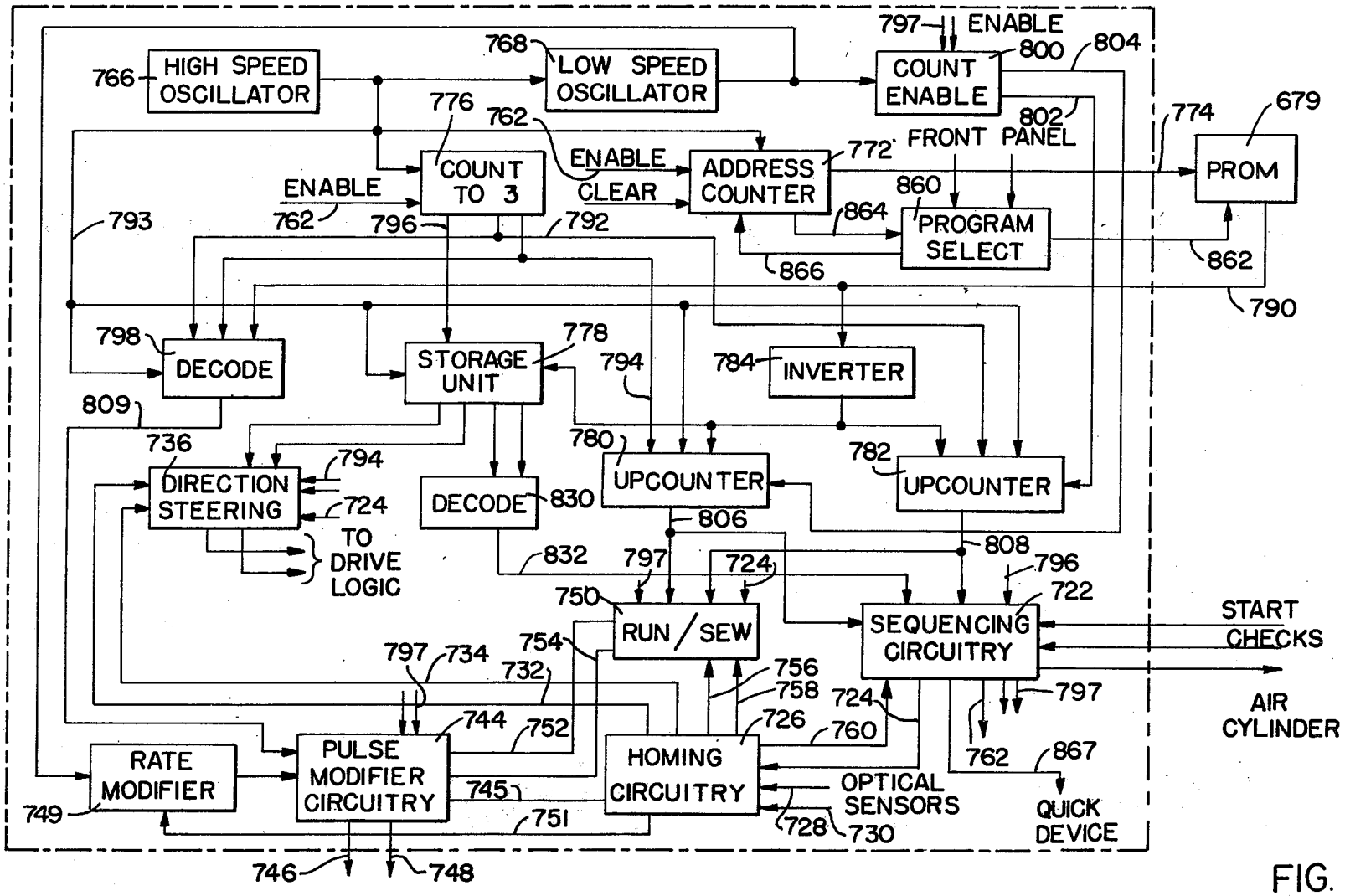
FIG. 32 is a block diagram of the central control logic for the sewing machine of the present invention.

The control logic 676 of FIG. 31 is shown in greater detail in FIG. 32. A sequencing circuitry 722 monitors over the cable labeled "CHECKS": (a) inputs from synchronization unit 62; (b) Clamp Sensor 308; (c) Thread Break Sensor 312; (d) cutter circuitry 697; (e) front panel 681; and (f) optical sensors 693 and 694 for both coordinate directions. Signals from the switches in foot pedal 678 are read over the line labeled "START". Gating logic circuits provided within the sequencing circuitry serve to halt machine and work holder operation if the proper operating conditions are not maintained. When the operator depresses the pedal 678 to actuate the Go Pedal Switch, this causes an enabling signal on line 724 to appear and initiate the first homing cycle when the Clamp Sensor indicates the work holder is closed. The homing operation insures that the work holder will be located at a predetermined initial position at the beginning of a sewing sequence.

Homing circuitry 726 operates together with the homing sensors and assemblies to preset the work holder at the desired locations for sewing in each of the two coordinate directions. As previously discussed, the coordinate directions are called X and Y, corresponding to a rectilinear coordinate system, although in the preferred embodiment the coordinate system is based on polar coordinates modified to approximate a rectilinear system. The homing circuitry, in response to the enabling signal over line 724 from the sequencing circuitry 722, provides output signals over lines 732 and 734 to a direction steering circuitry 736, based upon the inputs from optical sensors 693 and 694 over lines 728 and 730. These output signals indicate the direction in which the stepping motors should be moved. Direction steering circuitry 736 gates the signals on lines 732 and 734 to the motor drive logics 684 and 686 to control the direction of movement of the motors 58 and 60. The homing circuitry 726 also enables a pulse modifier circuitry 744 by a signal over line 745 so it is in condition to be enabled to provide output electrical pulses over lines 746 and 748 from the low speed oscillator 768. After the first homing approach, this output is preferably reduced in frequency by a rate modifier circuitry 749 to motor drive logics 684 and 686, as will be explained hereinafter, by the signals over a command line 751 from homing circuitry 726.

Pulse modifier circuitry 744 is enabled to gate these pulses to the motor drive logic by signals from a run/sew circuitry 750 over lines 752 and 754. Signals on one of these lines control the gating of pulses to one of the motors 58 or 60 while signals on the other control the gating of pulses to the other motor. The signals on lines 752 and 754 are provided by the run/sew circuitry 750 in the homing mode by a set of input signals over lines 756 and 758 from homing circuitry 726 when there exists an enabling signal over line 724 from the sequencing circuitry 722. The absence of signals over one of lines 756 or 758 and thus one of lines 752 or 754 causes the pulse modifier circuitry to inhibit pulsing to the corresponding stepping motor. This occurs whenever the home position for the corresponding coordinate direction has been achieved. For proper operation of the pulse modifier circuitry during the homing cycle, there must be enabling signals over line 745 and one or both of lines 752 or 754.

In all cases, the stepping motors overshoot the home position. When this occurs the optical sensors generate a signal which causes the motor involved to reverse and "zero in" on the correct home position. This is done by changing the signals over lines 732 and/or 734 according to information from the optical sensors to reverse the direction of one or both stepping motors. The homing circuitry also includes additional logic circuitry for insuring that the final approach of each motor to its home position is always from the same direction irrespective of the initial position of the work holder prior to homing. In addition, all homing motion after the first home approach in the basic home mode is accomplished at a reduced rate generated by rate modifier circuitry 749. Means in the homing circuitry 726, responsive to the optical sensor outputs, provide the signal over command line 751 for causing the stepping rate to be reduced. This mixture of stepping rates creates an optimally fast and accurate homing cycle.

In this particular embodiment there is always at least one change of direction of approach to the home position for each motor. If, after reversing the motor, the second approach direction during the auxiliary home mode is not the same as an approach direction predetermined in advance, the direction of motor rotation is automatically reversed again by logic in the homing circuitry which senses the direction of approach, and a third and final approach during a subauxiliary home mode is made from the predetermined approach direction for the motor or motors involved. In this way, greater accuracy in positioning the work holder is achieved. The work holder is moved slightly past the zero crossing position indicated by the homing sensors in both the X and Y directions.

When the first homing cycle has been completed a signal is placed by the homing circuitry on line 760 from the homing circuitry 726 to the sequencing circuitry 722. In response to this signal, the enable level on line 724 is immediately removed by the sequencing circuitry thereby preventing further movement of the work holder at this time. The sequencing circuitry then initiates a memory cycle by generating an enable signal level over a line 762. This signal level allows words from storage element 679 to be addressed and read as follows. The output of a high speed oscillator 766 is reduced by a counter here labeled low speed oscillator 768 whose output is one-tenth the frequency of the high speed oscillator. The low speed oscillator 768 provides periodic pulses which determine the rate at which the stepping motors will be driven. The enable signal on line 762 enables the address counter 772 whose output on line 774 represents the address of the word which will be read from the storage element. The enable signal on line 762 also enables a count to three counter 776 whose outputs determine into which of three receiving units the four bit words are separately placed. The three units comprise a storage unit 778 which receives the command portion of the instruction and the signs of the coordinate directions, upcounter 780 and upcounter 782. The two upcounters and storage unit respectively receive the work holder positioning data for each coordinate direction and command information in one's complement inverted form after it is inverted by an inverter 784 comprising several inverting gates.

In operation, the first clock pulse output of the high speed oscillator 766, after line 762 is enabled, increments address counter 772 resulting in a new four bit word being available from the storage element over lines 790. The same clock pulse also increments the count to three counter which causes an enabling signal to appear on one of its output lines, namely line 792 corresponding to a count of one. This in turn enables the upcounter 782 to store the four bit word containing Y position data in inverted form. The inverted four bit word is entered into the upcounter 782 by the trailing edge of the same first clock pulse over line 793.

In the same fashion, the next clock pulse from the high speed oscillator increments counters 772 and 776, and causes the inverse of the next addressed four bit word to be read into upcounter 780 as determined by an enabling signal from count to three counter over line 794. This corresponds to a count of two.

The third clock pulse from the high speed oscillator again increments counters 772 and 776 and causes the next addressed four bit word to be read in inverted form into storage unit 778 as determined by an enabling signal from the count to three counter over line 796. This corresponds to a count of three. The enabling signal on line 796 is also provided by a connection to the sequencing circuitry 722 in response to which the enabling signal on line 762 is removed. As a result, the count to three counter 776 is reset to zero, and address counter 772 is not incremented at this time. Accordingly, one complete instruction of twelve bits has been read from the memory and is stored, parts in each of upcounters 780 and 782, and storage unit 778.

All that remains to utilize this instruction is to translate it into movement of the stepping motors 58 and 60 and into motion of the sewing machine, as required. Where the read instruction required a sewing operation, this is accomplished by a signal from the synchronizing unit 62 which is connected to the sequencing circuitry over one of the lines entitled "CHECKS", and which causes the sequencing circuitry to provide enabling signals over lines 797 indicating that the needle is clear of the work piece. Where the read instruction did not require stitching, the equivalent of the Needle Disengage Signal from unit 62 is generated internally by logic means within the sequencing circuitry to produce enabling signals over lines 797 a short time after the new instruction is read into storage. In either instance, the enabling signals over line 797 are connected to the pulse modifier circuitry 744 which allows the stepping motors to be driven in accordance with the outputs of upcounters 780 and 782 whenever appropriate signals are present on line 752 and 754.

After the enabling signals are provided on lines 797, clock signals from the low speed oscillator increment upcounters 780 and 782 through a count enable circuitry 800 over lines 802 and 804. At the same time, the same clock signals from the low speed oscillator are connected to pulse modifier circuitry 744. Pulse trains from the pulse modifier circuitry to drive each stepping motor are derived from these low speed clock signals for each coordinate direction.

The outputs of upcounters 780 and 782 determine the number of output pulses there will be to step each motor in a given coordinate direction. The directions are determined by the direction indicating portions of the word stored in storage unit 778. The direction indicating portions are gated to the stepping motor drive logic by the direction steering logic 736. The number of output pulses to each motor corresponds to the data, the inverse of which was initially stored in the upcounters. The upcounters are constructed so that, when they have been incremented a number of times equal to the number of steps specified in the instruction, a separate carry output appears on lines 806 and 808. The carry outputs are sent to the run/sew circuitry and affect the pulse modifier circuitry 744 by run/sew circuitry 750 response over lines 752 and 754. As noted above, signals over one or the other of lines 752 or 754 indicate that a proper amount of input pulses from the low speed oscillator have been received for a particular coordinate direction. When each or both carry outputs appear (and, of course, they need not appear in the same clock cycle) the sequencing circuitry 722 causes the corresponding enable signals on lines 797 to be removed independent of each other, thereby indicating when the information for each coordinate direction contained in the instruction last read from the memory has been utilized.

The pulse modifier circuitry operates as follows. During the homing cycle when there is the enabling signal on line 745, pulses from the low speed oscillator are applied to the stepping motors in the coordinate direction or directions indicated by the signals on lines 732 and 734. During that portion of the logic operation when there are enabling signals on lines 797 due to a single instruction being utilized, the periodic pulses from the low speed oscillator 768 are gated according to the data stored in the upcounters 780 and 782 to provide pulse trains to the stepping motor drive logics over lines 746 and 748. If the number of steps in a coordinate direction is at least four, the associated upcounter or counters is precounted by one count, after which the pulse train for that direction is derived as follows.

After the enable signals on lines 797 appear, the first clock signal from the low speed oscillator is passed through the pulse modifier circuitry to the drive logic. The second and third clock signals from the low speed oscillators are blocked and an initial delayed pulse is added by the pulse modifier circuitry approximately equidistant between what would originally have been the second and third clock signals. The clock signals from the low speed oscillator after the third clock signal pass through circuitry 744 essentially unchanged as long as there is no change in signal level over whichever one of lines 752 or 754 corresponds to the coordinate direction concerned. After a change in signal level on one of lines 752 or 754 further clock signals from the low speed oscillator are blocked from forming part of the output pulse train for that coordinate direction. Thereafter two additional terminal delayed and spaced pulses are automatically added by the pulse modifier to the otherwise terminated output pulse train. These pulses are added at predetermined intervals of time following the last pulse in the train, the time intervals being greater than the time between pulses from the low speed oscillator. As a result, the drive pulses to the stepping motors are aperiodic, having a somewhat lower frequency at both the beginning and end of the pulse train and a higher frequency in the middle of the pulse train. This allows an increased machine cycle rate with smaller oscillations and therefore more accurate positioning.

If the number of steps in a particular coordinate direction is equal to three, this information is stored in decode circuitry 798, and is made available to the pulse modifier circuitry 744 over one of the lines 809. In response, the pulse modifier circuitry 744 alters its normal operation as described above, in order that the upcounter precount of one is inhibited and only one delayed terminal pulse is added upon appearance of the carry pulse for that particular coordinate direction.

When the information from storage element 679 was entered into upcounters 780 and 782, if the number of steps specified for either coordinate direction was one or two, this information was stored in decode circuitry 798 and is made available to the pulse modifier circuitry over line 809. The pulse modifier circuitry in response to this information from decode circuitry 798 alters its normal operation, described above, so that, if only two stepping pulses are required, only the initial delayed pulse is added and if only one pulse is required neither the initial nor the terminal delayed pulses are added.

When the called for number of X and Y steps has been obtained, as indicated by a change in the carry out signals from the upcounters, the associated enable signals 797 are removed. When both enabling signals have been removed, the sequencing circuitry, after a short delay, starts a new memory cycle, and provides an enable signal over line 762 to read the next instruction from memory. The operation of control circuitry 676 then repeats until an end of program signal is encountered.

Storage unit 778 stores the command and direction information as described above. Each bit of the command is connected to decode circuitry 830. Each output line of decode circuitry 830 collectively labeled 832 is associated with a particular command. The decode circuitry decodes the command stored in unit 778 and provides an enabling signal pulse on the one of its output lines 832 associated with that command. Output lines 832 are connected to the sequencing circuitry 722 where the commands are latched and amplified before being sent on to the Quick device over line 867 to control the operation of the sewing machine.

The sequencing circuitry utilizes the signals over lines 832 for two purposes. First to differentiate between stitch and no stitch commands to effect proper orientation of the Quick device, and, second, in response to an End of Program Command, to provide normal stopping and thread cutting between tacks of the same program and for end of program sequencing which includes signalling cutter circuitry 697 to cut the thread and return the work holder to its home position. To accomplish the latter operation, an enabling signal on a line 724 is generated in response to the End of Cut Signal from the cutter circuitry 697 in the presence of an "end of program" signal or command over one of the lines 832. After this second homing cycle is completed, the clamp is raised in response to a signal from central control logic 674 to a solenoid actuated air valve 814 through driver 812 so that the work piece can be removed.

The Quick device utilizes the signals over lines 867 from the sequencing circuitry 722 to stitch fast or slow, and to initiate a needle up and trim in response to the End of Program or Move Without Stitching Commands.

As shown in FIG. 32, program select circuitry 860 in response to the Program Select Switch has an output over line 862 which indicates to the PROM whether to choose the program from Bank A or B. The program select circuitry 860 and address counter 722 are interconnected by lines 864 and 866 to control switching between memory banks.

Figure 2:
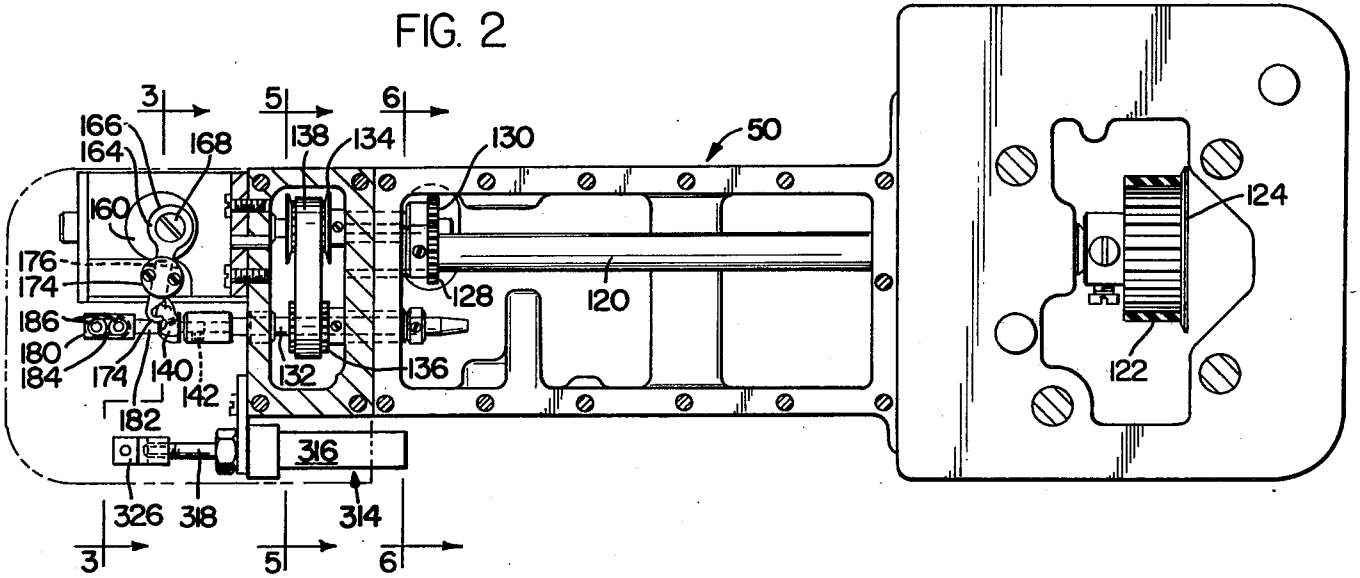
FIG. 2 is a sectional view taken substantially as indicated along the line 2—2 of FIG. 1.
Figure 6:
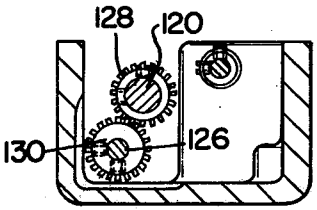
FIG. 6 is a sectional view taken substantially as indicated along the line 6—6 of FIG. 2.

The stitch forming mechanism for the chain-stitch sewing machine of the present invention is described as follows. With reference to FIG. 2, the sewing machine 50 has a lower drive shaft 120 which is driven at one end by a belt 122 passing around a pulley 124. As shown in FIGS. 2 and 6, the machine has an idler shaft 126 which is mounted for rotational movement by suitable bearings in the machine. As shown, the lower drive shaft 120 has a spur gear 128 secured to the shaft and meshed with a spur gear 130 which is secured to the idler shaft 126. The spur gears 128 and 130 are of a size to produce one rotation of the idler shaft 126 corresponding to one rotation of the drive shaft 120.

Figure 5:
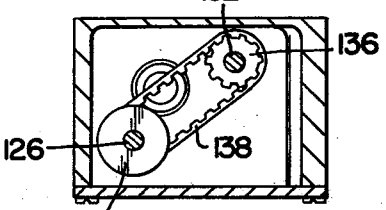
FIG. 5 is a sectional view taken substantially as indicated along the line 5—5 of FIG. 2.

The machine also has a hook shaft 132 which is mounted in the machine for rotational movement by suitable bearings, as shown. With reference to FIGS. 2 and 5, the idler shaft 126 has a sprocket 134 secured to the idler shaft, and the hook shaft 132 also has a sprocket 136 secured to the hook shaft in alignment with the sprocket 134. The sewing machine has a timing belt 138 passing around the sprockets 134 and 136 of the respective shafts 126 and 132, such that rotational movement of the idler shaft 126 is transmitted to the hook shaft 132 through the sprockets and timing belt. The sprockets 134 and 136 are of a size to produce one rotation of the hook shaft 132 corresponding to one rotation of the idler shaft 126. Thus, both the idler shaft 126 and hook shaft 132 are driven in rotational synchronism with the lower drive shaft 120.

Figure 10A:
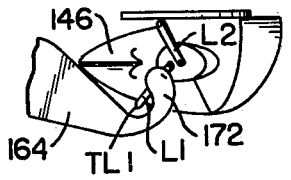
Figure 10B:
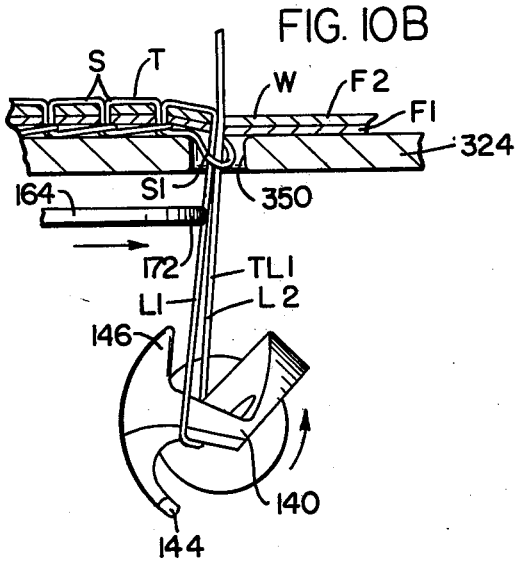

As illustrated in FIGS. 1–3, the sewing machine has a rotary butterfly hook or rotary looper 140 secured to an outer end of the hook shaft 132 by suitable means, such as a screw, such that the rotary hook 140 is driven by the hook shaft 132. With reference to FIGS. 10A and 10B, the rotary hook 140 has a hook point 144 and an opposed spur 146 for a purpose which will be described below.

Referring to FIGS. 3, 7, and 8, an outer end of the idler shaft 126 is received in a housing 148 and has a bevel gear 150 secured to the idler shaft 126 by suitable means, such as a screw 152. A vertical spreader shaft 154 is mounted for rotational movement in the housing 148, and a bevel gear 156 is secured to the shaft 154 by suitable means, such as a screw 158. The bevel gears 150 and 156 of the respective shafts 126 and 154 are meshed, such that the spreader shaft 154 is driven by the idler shaft 126 through the gears 150 and 156, with the gears being arranged to produce one rotation of the spreader shaft 154 corresponding to one rotation of the idler shaft 126. As illustrated in FIGS. 2, 3, and 7, the spreader shaft 154 has a circular plate 160 located above the housing 148, with the plate 160 having an upright eccentric stud 162. The sewing machine has a retainer or spreader 164 which has a bore at its driven end 166 to receive the eccentric stud 162, and the end 166 of the spreader 164 may be secured on the stud 162 by a screw 168 received in a threaded bore 170 of the stud 162, such that the spreader end 166 is permitted to rotate on the stud 162.

Figure 9:
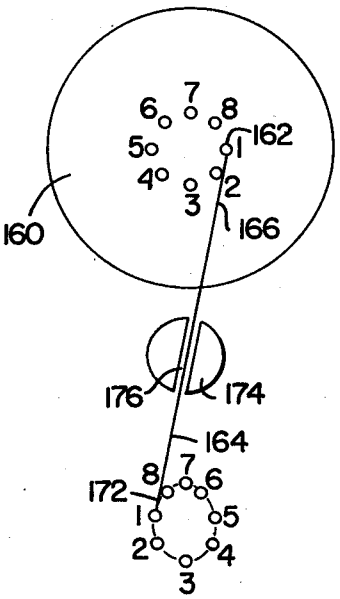
FIG. 9 is a diagrammatic view illustrating the configuration of a spreader during movement according to the present invention.

The spreader 164 has a hook member 174 at its other end, while a central portion of the spreader 164 intermediate the end 166 and hook member 172 is received in a swivel member 174. The swivel member 174 is mounted for rotational movement in the housing 148, and has a slot 176 to slidably receive the central portion of the spreader 164. Accordingly the spreader 164 is permitted to slide through the slot 176 of the swivel member 174 while the swivel member 174 rotates in the housing 148. The resulting motion of the spreader 164 is illustrated in diagrammatic form in FIG. 9, with corresponding positions of the eccentric stud 162 and hook member 172 being designated by corresponding numbers during a cycle of the device. As shown, as the plate 160 rotates through a complete revolution, the eccentric stud 162 and associated spreader end 166 traverse a generally circular path while the spreader 164 slides through the slot 176 of the swivel member 174 and while the swivel member 174 rotates in the housing. As a result, the hook member 172 of the spreader 164 traverses a generally circular path, although slightly elliptical, with one revolution of the hook member 172 corresponding to one revolution of the eccentric stud 162 and plate 160. As previously discussed, the various gears, shafts, and timing belt are arranged in a manner to produce one rotation of the spreader shaft corresponding to one rotation of the hook shaft, and it will be apparent that the hook member 172 of the spreader 164 is driven in synchronism with the rotary hook 140, such that one revolution of the hook member 172 corresponds to one revolution of the rotary hook 140.

Figure 11A:
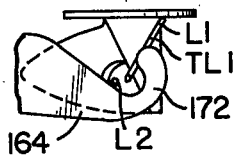
Figure 11B:
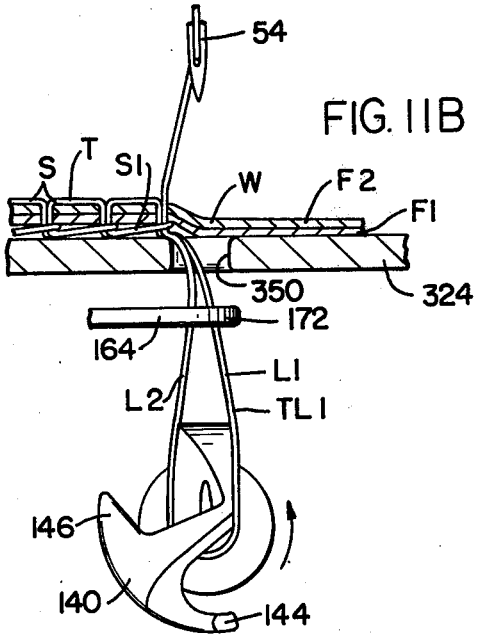

The operation of the stitch forming mechanism of the present embodiment of the machine is described in connection with FIGS. 10A–15B. As shown in FIG. 10B, two fabrics F1 and F2 of the work piece W are being sewn by the chain-stitch sewing machine on the throat plate 324, with a plurality of stitches S of the thread T having been formed in the work piece. As illustrated in FIGS. 10A and 10B, the previous thread loop TL1 is received on the rotary hook 140 as the last stitch S1 is being pulled up and as the hook member 172 of the spreader 164 is being moved into position to grasp the limbs L1 and L2 of the previous thread loop TL1. As illustrated in FIGS. 11A and 11B, the work piece has been moved slightly on the throat plate 324 to position the work piece for forming another stitch, and the previous stitch S1 has been pulled up. Also, the rotary hook 140 has been moved slightly, the hook member 172 has been moved into position for grasping the limbs L1 and L2 of the previous thread loop TL1, and the needle has descended for subsequent passage through the work piece and opening 350 of the throat plate 324.

Figure 12A:
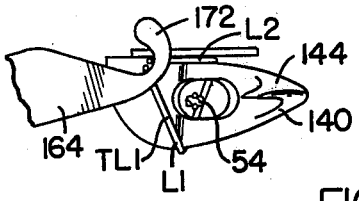
Figure 13A:
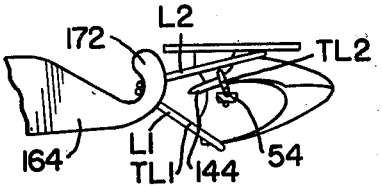
Figure 12B:
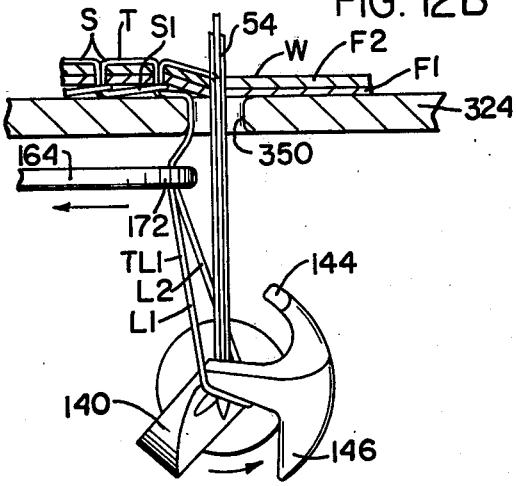
Figure 13B:
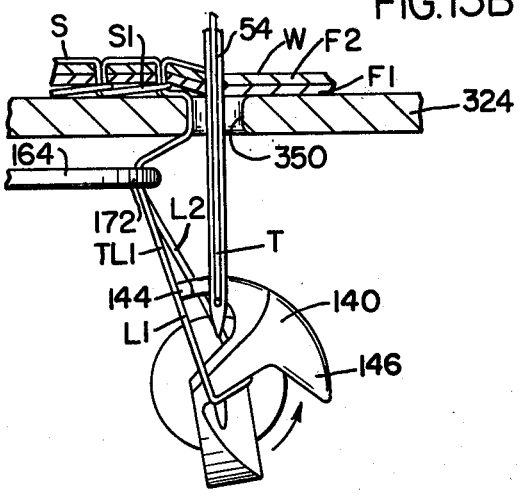

Referring to FIGS. 12A and 12B, the rotary hook 140 is shown as being rotated to a further position, the hook member 172 of the spreader 164 has grasped the limbs L1 and L2 of the previous thread loop TL1 and is pulling the limbs to the left as viewed in the drawings, while the needle 54 has descended to the downward part of its stroke. Referring to FIGS. 13A and 13B, the needle 54 has ascended slightly, and the hook point 144 of the rotary hook 140 has been received through the new thread loop TL2 formed on the back side of the needle 54. Also, the hook member 172 of the spreader 164 has pulled the limbs L1 and L2 of the previous thread loop TL1 to a position forming a triangle of the previous thread loop extending from the rotary hook 140 to assure passage of the hook point 144 between the limbs L1 and L2 of the previous thread loop TL1 irrespective of the direction in which the work piece is being sewn, thus preventing a missed stitch.

Referring to FIGS. 14A and 14B, the hook point 144 of the rotary hook 140 has brought the new thread loop TL2 through the previous thread loop TL1, while the hook member 172 of the spreader 164 has started to release the limbs L1 and L2 of the previous thread loop TL1, and while the needle 54 has ascended out of the work piece. As shown in FIGS. 15A and 15B, the hook member 172 of the spreader 164 has released the limbs of the previous thread loop TL1, and the spur 146 of the rotary hook 140 retains the previous thread loop TL1 until the previous thread loop is ready to be pulled up. After the previous thread loop TL1 has been cast off the rotary hook 140, the previous thread loop TL1 is pulled up to form another stitch, and the operation is repeated. Thus, the stitch forming mechanism permits formation of chain stitches without missing stitches irrespective of the direction in which the work piece is moved on the throat plate.

Figures 16, 17:
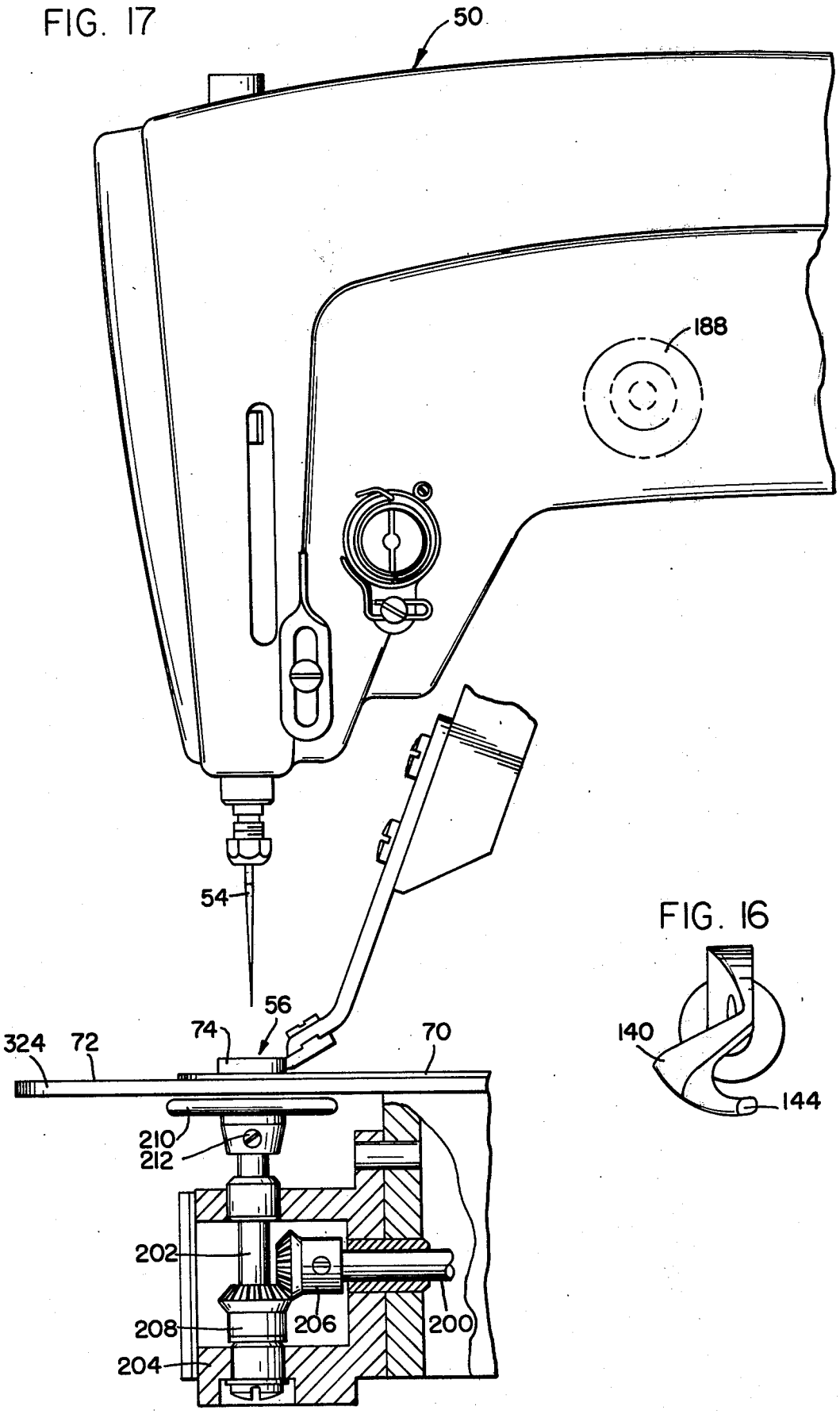
FIG. 16 is an end view of another embodiment of a rotary hook according to the present invention.
FIG. 17 is a fragmentary side elevational view, taken partly in section, of another embodiment of a spreader mechanism according to the present invention.

As illustrated in FIG. 2, the sewing machine may have a needle guard 180 mounted on the underside of the throat plate. The needle guard 180 has a blade 182 having a slot 184 to receive a pair of screws 186 which extend into the throat plate. The screws 186 are utilized to secure the blade 182 and adjust its position relative the needle, such that the blade 182 brushes against the near side of the needle to assure that a thread loop is formed on the remote back side of the needle for receiving the hook point of the rotary hook. With reference to FIGS. 16 and 17, the spur may be deleted from the rotary hook 140, if desired, and a nipper 188 is provided on the machine to retain the thread after the new needle thread loop is cast off the rotary hook and during pull-up time of the previous thread loop.

Another embodiment of the sewing machine 50 is illustrated in FIG. 17, in which like reference numerals designate like parts. In this embodiment, a shaft 200 is mounted for rotational movement in the machine, and the shaft 200 is driven by any suitable means in rotational synchronism with the hook shaft, such that one rotation of the hook shaft corresponds to one rotation of the shaft 200. The machine has a vertical spreader shaft 202 mounted for rotational movement in a housing 204. The shaft 200 has a bevel gear 206 secured to an outer end of the shaft 200, and the spreader shaft 202 has a bevel gear 208 secured to the spreader shaft 202 and meshed with the bevel gear 206. The machine has a deflector or rotary spreader 210 secured to an upper end of the spreader shaft 202 by suitable means, such as a screw 212. The bevel gears 206 and 208 are arranged to drive the spreader shaft 202 in rotational synchronism with the shaft 200, such that one rotation of the shaft 200 results in one rotation of the spreader shaft 202 and associated deflector 210. Accordingly, the deflector 210 is rotated in synchronism with the rotary hook in a manner that the deflector 210 makes one complete revolution corresponding to one revolution of the rotary hook.

Figure 18A:
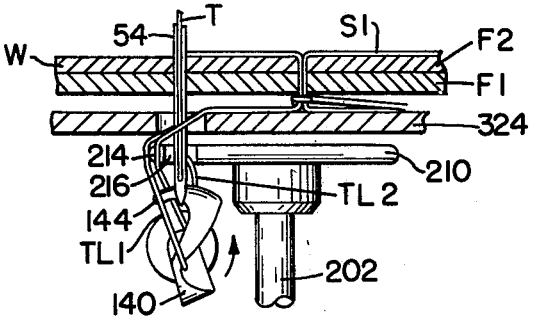
Figure 18B:
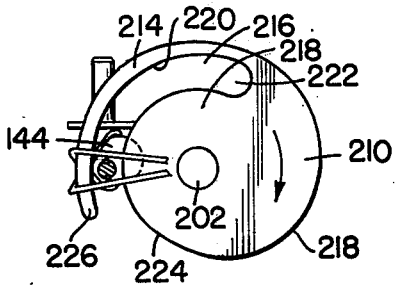

As illustrated in FIG. 18B, the deflector 210 has a deflecting arm 214 defining a needle receiving slot 216 intermediate the arm 214 and an inner portion 218 of the deflector 210. The inner edge 220 of the deflecting arm 214 has a fairly constant radius relative the center of the spreader shaft 202, and the inner portion 218 of the deflector 210 has a fairly constant radius relative the center of he shaft 202 from a point adjacent an inner end 222 of the needle slot 216 to a point 224 adjacent the outer end 226 of the arm 214. The radius of the inner portion 218 of the deflector 210 increases from the point 224 to a point 218 where the radius of the deflector 210 is approximately the same from the point 218 to the outer end 226 of the arm 214.

The use of the deflector 210 and rotary hook 140 to form chain-stitches in the work piece is described in connection with FIGS. 18A–21B, in which the two fabrics F1 and F2 of the work piece W are shown slightly spaced from the throat plate 324 for convenience of illustration. With reference to FIGS. 18A and 18B, the previous stitch S1 has been formed in the work piece and has been pulled up, and the needle 54 is ascending through the needle slot 216 of the deflector 210, the opening 350 of the throat plate 324 and the work piece W. The hook point 144 of the rotary hook 140 has been received through the needle thread loop TL2, and the deflecting arm 214 has formed an open triangle from the limbs of the previous thread loop TL1 in order to receive the hook point 144 of the rotary hook 140 and assure passage of the new thread loop TL2 through the previous thread loop TL1, as will be further discussed below.

Figure 19A:
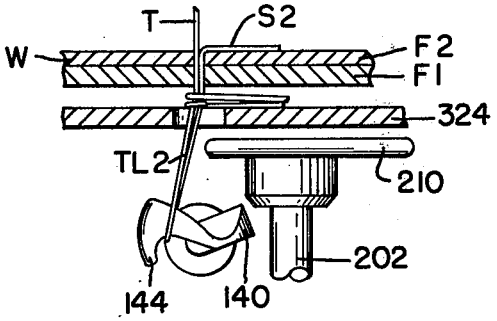
Figure 19B:
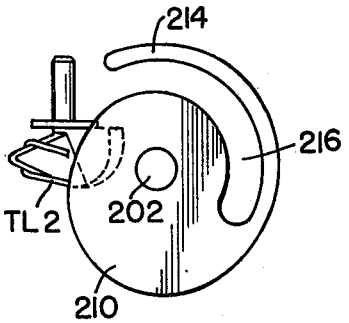
Figure 20A:
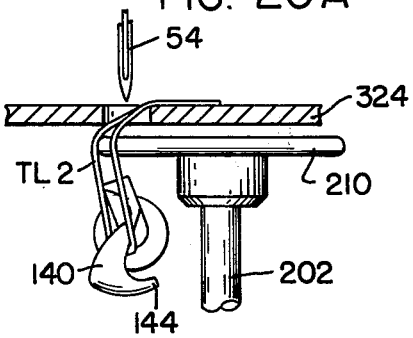
Figure 21A:
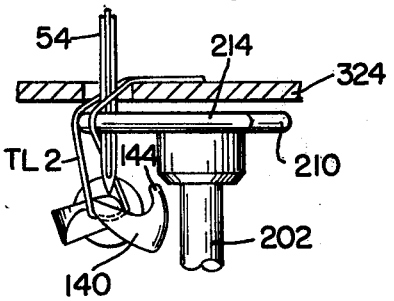
Figure 20B:
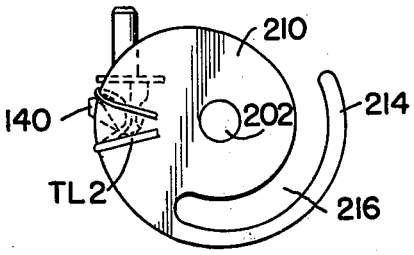
Figure 21B:
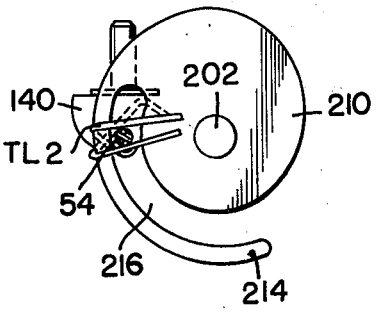

Referring to FIGS. 19A and 19B, the previous thread loop has been cast off the rotary hook 140, and has been pulled up to form a new stitch S2 in the work piece W. Referring to FIGS. 20A and 20B, the deflector 210 has been rotated to a position such that the outer edge of the deflector or spreader 210 has contacted and pushed the limbs of the new thread loop TL2 to spread the thread loop limbs. With reference to FIGS. 21A and 21B, the retainer 210 has been rotated to a position aligning the needle slot 216 with the descending needle 54 such that the needle passes through the slot 216 on its downward stroke and between the limbs of the thread loop TL2. Referring again to FIGS. 18A and 18B, the deflector 210 maintains the open triangle of the thread loop extending from the rotary hook 140 as the thread loop moves toward the outer end 226 of the deflecting arm 214 to assure passage of the hook point 144 and new thread loop through the limbs of the previous thread loop. In this manner, the chain-stitches are formed in the work piece while moving the work piece in any desired direction on the throat plate between stitches and while preventing skipped stitches in the work piece.

Thus, in accordance with the present invention, the sewing machine has a stitch forming mechanism which permits movement of the work piece along any direction while forming chain-stitches in a manner preventing missed stitches. The work piece is retained and moved by the work holder 56 to form a stitch pattern of chain-stitches in the work piece. The pattern formed in the work piece is defined by the information contained in the PROM, which contains data associated with each stitch indicating the direction and distance to be moved between stitches along the two coordinate directions. Thus, the work piece is moved in a plane along the two coordinate directions, and the positional information may be utilized to form successive stitches of variable length in a selected direction in the plane. In addition, the positional information may indicate that the work holder should not be moved along one or both coordinate directions between successive stitches. Thus, a series of instructions may be used at the end of a sewing sequence or operation to instruct the work holder to maintain the work piece at a specified location while the needle is being reciprocated a plurality of times through the work piece. In other words, the work piece is retained at a specified location after the pattern is sewn in the work piece in a manner to permit the needle to reciprocate through a single opening in the fabric a number of times, such as two or three.

In this manner, the control system is utilized to accurately position the work piece relative the needle to form a knot structure of the thread below the work piece and prevent unravelling of the stitch formation which has been sewn into the work piece. The formation of the knot structure below the work piece by the sewing machine of the present invention is described in connection with FIGS. 22–30, in which the fabric is shown slightly moved from the opening 350 of the throat plate 324 in FIGS. 23–30 and has a right hand portion removed for convenience of discussion.

Figure 22:
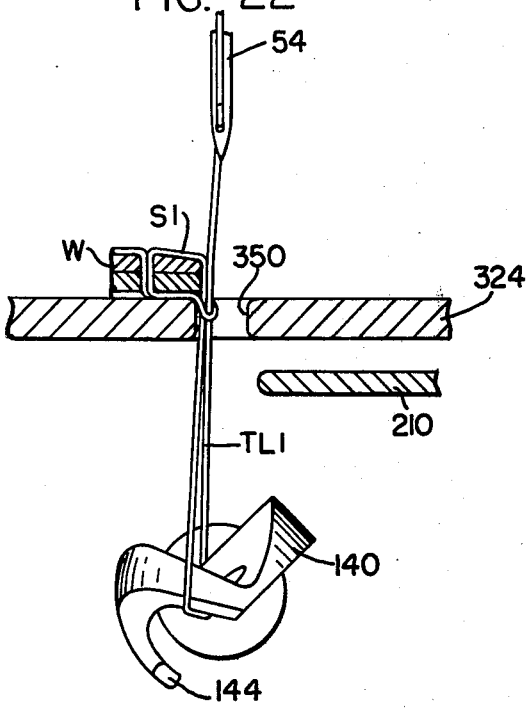
FIGS. 22–30 are fragmentary end views, taken partly in section, illustrating formation of a knotted thread structure extending from a stitch pattern in the work piece according to the present invention.
Figure 23:
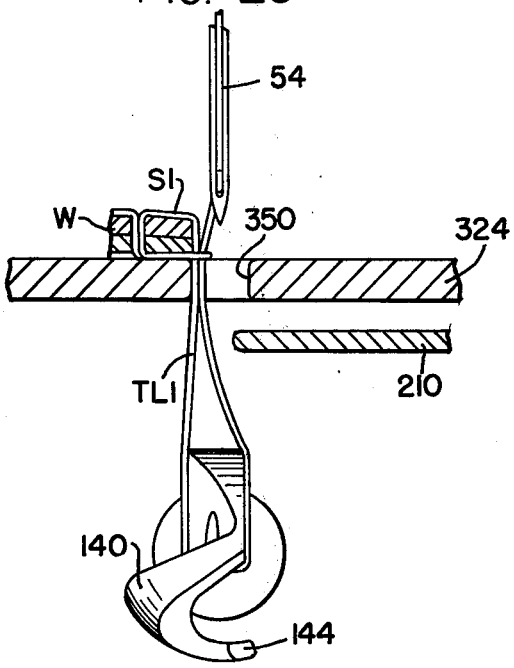
Figure 24:
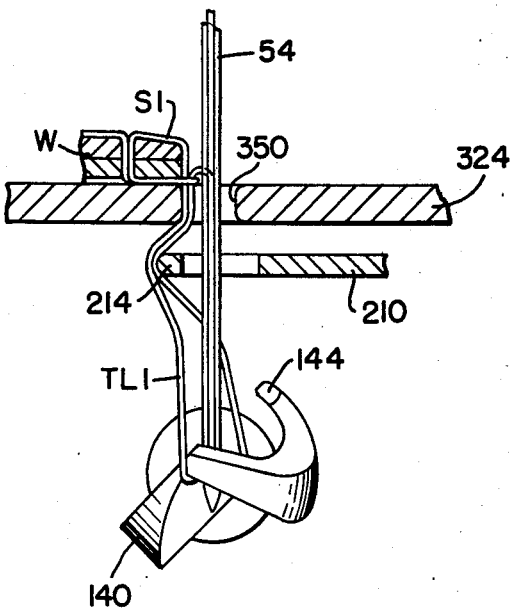
Figure 25:
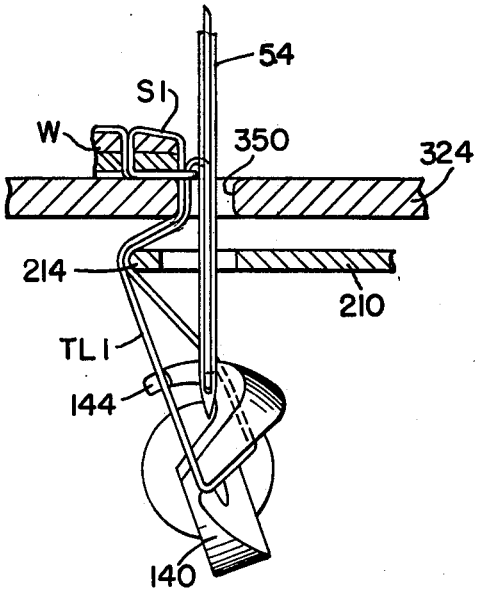
Figure 26:
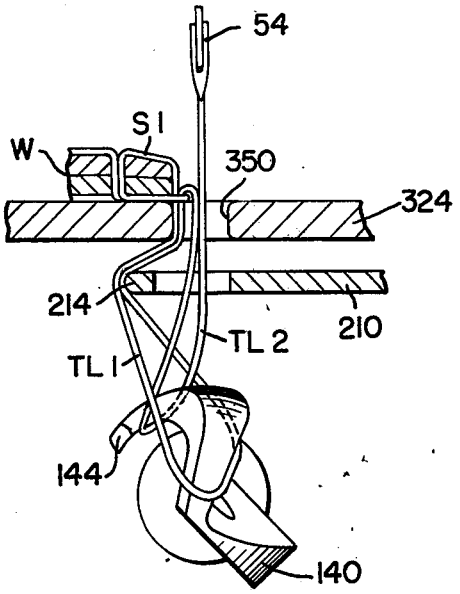
Figure 27:
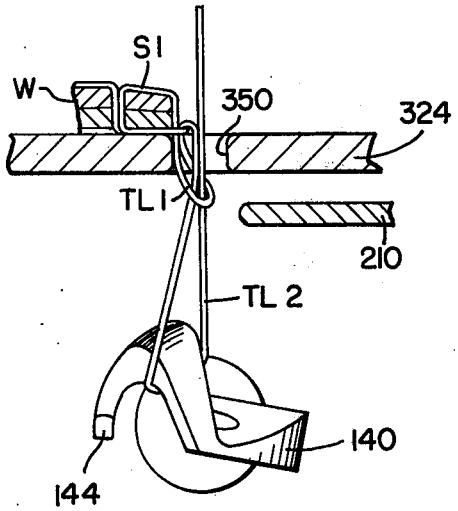
Figure 28:
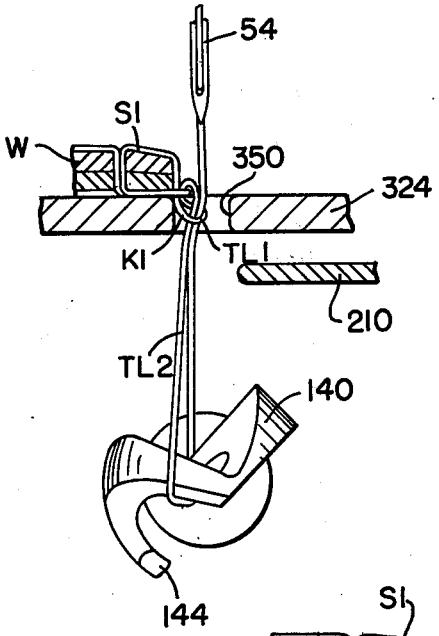
Figure 29:
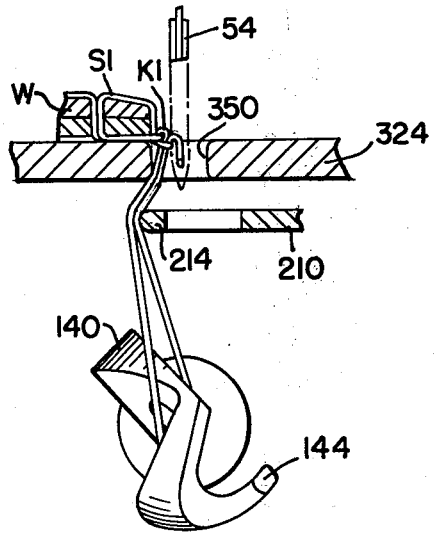

As shown in FIG. 22, the thread loop TL1 is retained on the rotary hook 140, and the previous thread loop has been substantially pulled up to form the stitch S1 in the work piece W. As illustrated in FIG. 23, the rotary hook has moved slightly, and the positional information in the PROM has directed the work holder to retain the work piece W at the same position, in order that the needle 54 will descend through the same opening in the work piece. Referring to FIG. 24, the needle 54 has descended to the lower part of its stroke, and the thread associated with the new thread loop to be formed passes through the previous needle opening, since the work piece W remains fixed relative the needle. Next, as shown in FIG. 25, the hook point 144 of the rotary hook 140 passes through the new thread loop on the back side of the needle 54 and through the previous thread loop TL1, such that the new thread loop TL2 is brought through the previous thread loop TL1 by the hook point 144, as illustrated in FIG. 26, while the needle ascends from the work piece. As shown in FIGS. 27 and 28, the previous thread loop TL1 is cast off the rotary hook 140, and is pulled up to form a first knot K1 on the new thread loop TL2 below the work piece. With reference to FIG. 29, the next instruction in the PROM directs the work holder to retain the work piece W at the same position, in order that the needle descends through the same needle opening in the work piece to repeat the knotting procedure again and form a second knot below the work piece.

Figure 30:
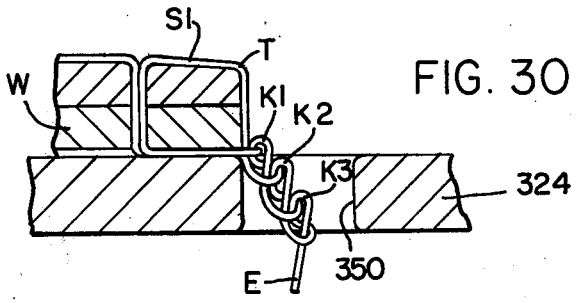

With reference to FIG. 30, this procedure is repeated a plurality of times in order to form a plurality of successive knots K1, K2, and K3 below the work piece W and to form a knotted structure of the thread T extending from the stitch S1. At this time, an End of Program or Move without Stitching Command may be located in the PROM in order to initiate the cutting sequence. In response, the cutting device 314, previously described in connection with FIG. 4, is actuated to sever the end of the thread T below the last knot K3 and produce an end E of the thread T which is knotted through the third knot K3. In this manner, a knotted end of the chain-stitches is formed to prevent unravelling of the stitch pattern during use of the fabric. Thus, in accordance with the present invention, the work piece is moved in any direction along a plane to form a complex pattern of chain stitches in the fabric, after which the control system is utilized to form a knotted thread structure at the end of the stitch pattern and to sever the thread. In the event that the thread was severed pursuant to a Move without Stitching Command in the PROM, the work piece may be moved to a spaced location, and another sewing pattern may be formed in the work piece.

The foregoing detailed description is given for clearness of understanding only, and no unnecessary limitations should be understood therefrom, as modifications will be obvious to those skilled in the art.

What is claimed is:

1. An automatic chain-stitch sewing machine for forming an improved stitch pattern in a work piece, comprising:

a sewing needle;

a work holder for retaining the work piece during sewing and being movable in a plane relative the needle;

a rotary hook having a hook point for capturing a needle thread loop and drawing the loop through a previous thread loop;

means for driving said hook;

means for spreading the limbs of the previous thread loop and retaining them open while the rotary hook passes the captured thread loop through the spread limbs to prevent a missed stitch irrespective of the direction in which the work piece is moved in said plane relative the needle between stitches;

memory means having a plurality of instructions containing directional and positional information designating the direction and magnitude of movement of the work holder along separate coordinate directions in said plane relative the needle, said positional information being potentially variable to designate selected magnitudes of variable distance along both coordinate directions, and being capable of designating a fixed position of the work holder relative the needle between successive stitches along both coordinate directions, said memory means being capable of specifying simultaneous movement along both of said separate coordinate directions;

means for reading said instructions and for forming electrical signals representing the instructions; and driving means responsive to said signals for moving the work holder in said plane relative the needle in the designated directions and magnitudes, said memory means including a plurality of instructions directing the work holder to form a pattern of chain-stitches in the work piece and a plurality of instructions at the end of the designated pattern directing the work holder to remain at a fixed position along both coordinate directions while reciprocating the needle through the work piece a plurality of times to form a knotted thread structure below the work piece extending from the pattern to prevent unravelling of the sewn pattern.

2. The sewing machine of claim 1 wherein said rotary hook includes a spur at a location opposed to said hook point for retaining the previous thread loop prior to being pulled up while forming a stitch.

3. The sewing machine of claim 1 wherein the spreading means comprises, a deflector driven in rotational synchronism with the rotary hook, said deflector having a deflector arm for engaging and spreading the limbs of the previous thread loop and defining a slot to receive the needle while capturing the thread loop with the rotary hook.

4. The sewing machine of claim 1 wherein the spreading means comprises, a retainer having a hook member adjacent one end for engaging and spreading the limbs of the previous thread loop, means for driving the other end of the retainer in a generally circular path, and swivel means rotationally mounted at a fixed position and receiving a central portion of the retainer to permit sliding movement of the retainer through the swivel means.

5. The sewing machine of claim 1 wherein the memory means comprises a non-volatile, non-destructive, randomly addressable memory.

6. The sewing machine of claim 5 wherein the reading means comprises means for sequentially reading said memory.

7. The sewing machine of claim 1 including means for cutting the sewing thread, and in which the memory means includes at least one command directing the cutting means to cut the thread extending from the knotted thread structure.

8. The sewing machine of claim 1 wherein said memory means includes a command directing the driving means to move the work holder to a location with the needle spaced from the knotted thread structure for forming a spaced sewing pattern in the work piece.

9. In an automatic chain-stitch sewing machine of the type comprising, a sewing needle, a work holder for retaining the work piece during sewing and being movable in a plane relative the needle, a rotary hook having a hook point for capturing a needle thread loop and drawing the loop through a previous thread loop, means for driving said hook, means for spreading the limbs of the previous thread loop and retaining them open while the rotary hook passes the captured thread loop through the spread limbs to prevent a missed stitch irrespective of the direction in which the work piece is moved in said plane relative the needle between stitches, a memory unit capable of retaining a plurality of instructions containing directional and positional information designating the direction and magnitude of movement of the work holder along separate coordinate directions in said plane relative the needle, with the positional information being potentially variable to designate selected magnitudes of variable distance along both coordinate directions, and being capable of designating a fixed position of the work holder relative the needle between successive stitches along both coordinate directions, and with the memory unit being capable of specifying simultaneous movement along both of said separate coordinate directions, means for reading said instructions and for forming electrical signals representing the instructions, and driving means responsive to said signals for moving the work holder in said plane relative the needle in the designated directions and magnitudes, a method of controlling operation of the sewing machine comprising the steps of providing the memory unit with a plurality of instructions directing the work holder to form a pattern of chain-stitches in the work piece and providing the memory unit with a plurality of instructions at the end of the designated pattern directing the work holder to remain at a fixed position along both coordinate directions while reciprocating the needle through the work piece a plurality of times to form a knotted thread structure below the work piece extending from the pattern to prevent unravelling of the sewn pattern.

* * * * *